United States Patent [19]

Abondance

[11] Patent Number: 4,861,063

[45] Date of Patent: Aug. 29, 1989

[54] DOWNHILL SKI WITH ELONGATED TIP

[75] Inventor: Roger Abondance, Rives, France

[73] Assignee: Skis Rossignol S.A., Voiron, France

[21] Appl. No.: 214,361

[22] Filed: Jul. 1, 1988

[30] Foreign Application Priority Data

Jul. 9, 1987 [FR] France ..... 87 10321

[51] Int. Cl.[4] ..... A63C 11/00

[52] U.S. Cl. ..... 280/601; 280/609; 280/809

[58] Field of Search ..... 280/609, 602, 601, 610, 280/809, 816, 817

[56] References Cited

U.S. PATENT DOCUMENTS

| | | | |
|---|---|---|---|
| 3,501,160 | 3/1970 | Lange | 280/609 |
| 3,820,820 | 6/1974 | Davis | 280/601 |
| 3,933,360 | 1/1976 | Arai | 280/609 |
| 4,262,927 | 4/1981 | Hochstrasser | 280/609 |

FOREIGN PATENT DOCUMENTS

| | | | |
|---|---|---|---|
| 262116 | 8/1967 | Austria | 280/609 |
| 0162012 | 11/1985 | European Pat. Off. | 280/602 |
| 2294724 | 7/1976 | France | 280/609 |
| 587723 | 1/1959 | Italy | 280/601 |
| 159966 | 4/1933 | Switzerland | 280/609 |

*Primary Examiner*—David M. Mitchell

*Attorney, Agent, or Firm*—Browdy and Neimark

[57] ABSTRACT

The tapered tip of the ski is extend by an added deflector which has a dissymmetric downstream approximately horizontal part.

4 Claims, 1 Drawing Sheet

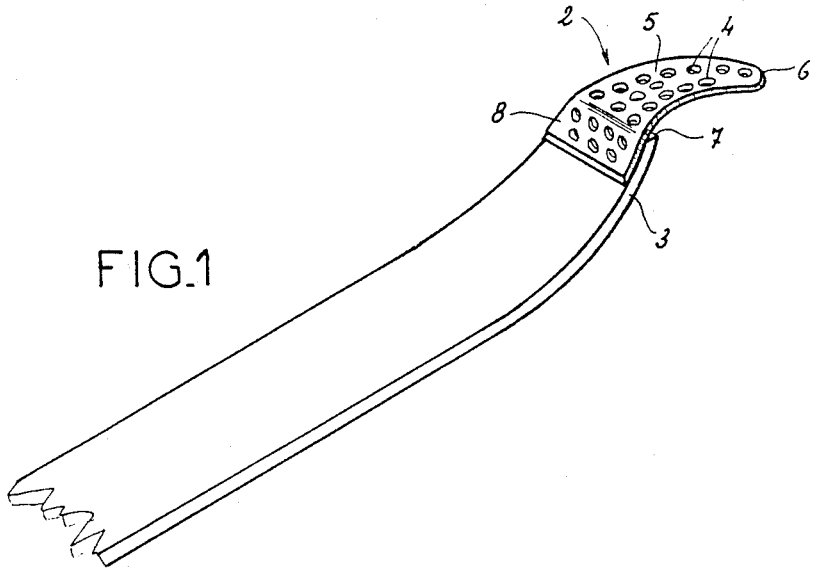
FIG.1
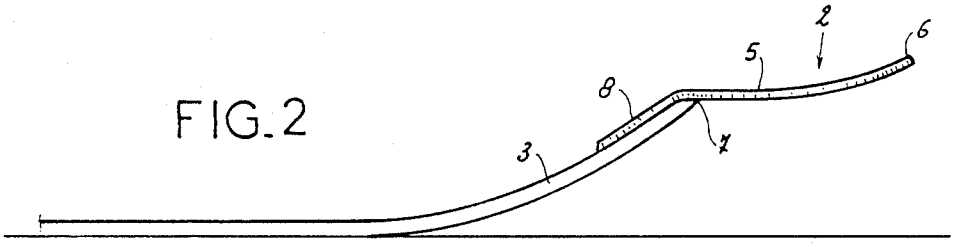
FIG.2
FIG.3
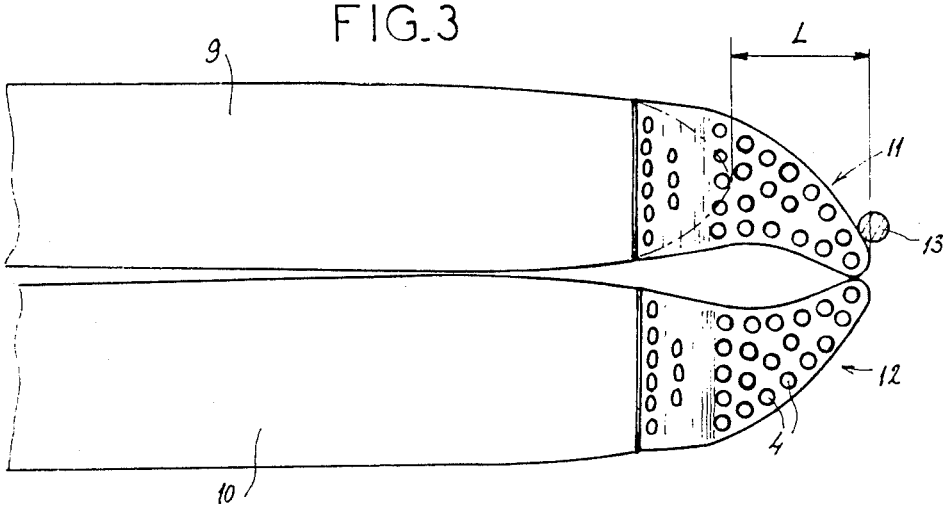

DOWNHILL SKI WITH ELONGATED TIP

BACKGROUND OF THE INVENTION

1. Field of the Invention

This invention relates to a downhill ski with an elongated tip, this ski being intended more particularly for competition, and especially for slalom runs.

2. The Prior Art

During a slalom run, the skier is made to clear gates delimited by two poles. During bad passage of a gate, he runs the risk of straddling one of the two poles and consequently of wounding himself. To increase the skier's safety while giving him more chances of clearing the slalom gates, it is known to add to the pointed end of the ski tip an asymmetric curved piece which extends this tip by making the point of the ski dissymmetric in the direction of the other ski of the same pair. This added piece, often called a "deflector," has the drawback, however, of increasing the weight of the ski. To mitigate this drawback, the deflectors are made relatively short, so that their effectiveness is not optimal.

SUMMARY OF THE INVENTION

The invention intends to remedy this drawback by means of a ski comprising an asymmetric deflector which can be made with a greater length than these known deflectors, while contributing to the ski the same weight as the latter. For this purpose, the tip of this ski is cut along a transverse line, and this asymmetric deflector comprises an upstream part which is placed on the top of the tapered end of this tip, this upstream part consequently assuming the shape of this tapered end and being connected, at the level of this transverse line, to a downstream projecting part, this downstream part being dissymmetric and approximately horizontal. This downstream part ends in a point directed toward the other ski of the pair, this point being, according to an another advantageous characteristic, slightly raised.

Also advantageously, this asymmetric deflector is pierced with one or more holes.

BRIEF DESCRIPTION OF THE DRAWINGS

In any case, the invention will be better understood, and its advantages and characteristics will come out during the following description of a nonlimiting example of embodiment of this ski, with reference to the accompanying diagrammatic drawings, in which:

FIG. 1 is a perspective view of the front part of this ski;

FIG. 2 is a lateral view; and

FIG. 3 shows, in top view, the front part of a part of skis of this type.

DETAILED DESCRIPTION OF THE PREFERRED EMBODIMENT

FIGS. 1 and 2 represent a ski for the left foot. This ski, which is a slalom ski, comprises an asymmetric deflector 2 which is added by gluing or by any other means to the ski tip 3 and continues to decrease in width while being curved in the direction of the other ski of the pair, a great part 5 of this deflector projecting relative to this tip 3. Deflector 2 is pierced with holes 4, on the one hand, to make it lighter and, on the other hand, to improve its penetration in the air. Projecting part 5 is approximately horizontal, its pointed end 6, however, is slightly raised.

The end, standardly pointed, of tip 3 is tapered, this tip having previously been sectioned or cut along a transverse line 7 which is transverse to the longitudinal direction (that is, longest direction) of the ski. Upstream part 8 of deflector 2 assumes exactly the shape of the top of the tapered end of tip 3, and this upstream part 8 is connected progressively, at the level of transverse line 7, to the approximately horizontal part 5.

FIG. 3 shows a pair of skis 9, 10 made in the same way as the ski according to FIGS. 1 and 2. These skis 9, 10 are therefore equipped with added deflectors 11, 12 which are each curved, in top view, in the direction of the other ski of the same pair (10 and 9, respectively).

The addition in length, relative to the standard ski without a deflector, which is imparted by a deflector such as 11, is referenced by L. Because of the flattened shape of deflector 11, this addition L is greater, for an equal amount of added material, than that imparted by a known asymmetric deflector whose shape extends that of the complete tip to which it is added. The danger of straddling slalom pole 13 is consequently reduced. Also because of the flattened shape of deflector 11, the angle of contact between this deflector and the pole is approximately a right angle, whereas with a traditional tip or a known deflector, whose shape extends that of the tip, this angle of contact is around 45 degrees. This embodiment also contributes to limiting the risk of straddling slalom pole 13.

The underslung length of this deflector enables the ski to be engaged in the turn at the moment of digging in the edge of the inside ski. By its flattened shape, it allows the ski to miss the pole more easily and consequently enables the skier to escape it more easily. The turning path of the ski is thus narrower and allows a faster speed in passing the slalom gates.

Of course, the invention is not limited to the embodiment just described. Rather it takes in all equivalents. For example, instead of being added, the elongated tip, comprising this deflector, can be integrated into the structure of the ski during its production, for example, by molding.

I claim:

1. A downhill ski comprising an asymmetric deflector projecting on an upwardly extending tip tapered along a longitudinal line of the ski and ending in a horizontal transverse line, the asymmetric deflector comprising an upstream part which is placed on top of the tapered end of the tip, the upstream part consequently assuming the shape of the tapered end and being connected, at the level of said transverse line, to a projecting downstream part, the downstream part being dissymmetric and approximately horizontal, said deflector having an end which is directed toward the other ski of a pair of skis, wherein said end is slightly raised with respect to the remainder of the deflector, and is offset toward an inside side relative to the longitudinal median plane of the ski.

2. The ski according to claim 1, wherein the deflector is pierced with one or more holes.

3. The ski according to claim 1, wherein the asymmetric deflector is added to the tapered tip.

4. The ski according to claim 1, wherein the asymmetric deflector is integrated into the structure of the ski during its production.

* * * * *